US011404828B2

(12) United States Patent
Zhang et al.

(10) Patent No.: US 11,404,828 B2
(45) Date of Patent: Aug. 2, 2022

(54) CONNECTOR ASSEMBLY

(71) Applicant: Tyco Electronics (Shanghai) Co. Ltd., Shanghai (CN)

(72) Inventors: Jiefeng Zhang, Shanghai (CN); Wenbo Lv, Shanghai (CN); Ming Lei, Shanghai (CN); Ning Wang, Shanghai (CN); Bo Gao, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/715,546

(22) Filed: Dec. 16, 2019

(65) Prior Publication Data

US 2020/0119496 A1 Apr. 16, 2020

Related U.S. Application Data

(63) Continuation of application No. PCT/EP2018/065707, filed on Jun. 13, 2018.

(30) Foreign Application Priority Data

Jun. 16, 2017 (CN) ..... 201710455276.2

(51) Int. Cl.
*H01R 13/6582* (2011.01)
*H01R 12/53* (2011.01)
*H01R 13/74* (2006.01)

(52) U.S. Cl.
CPC ..... *H01R 13/6582* (2013.01); *H01R 12/53* (2013.01); *H01R 13/74* (2013.01)

(58) Field of Classification Search
CPC .... H01R 13/6582; H01R 12/53; H01R 13/74; H01R 13/646
USPC ..... 439/607.01, 607.27, 607.13, 607.35, 439/607.36, 607.41, 607.44, 607.48, 439/607.53, 620.16, 620.15, 620.19, 439/620.1
See application file for complete search history.

(56) References Cited

U.S. PATENT DOCUMENTS 6,059,581 A * 5/2000 Wu ..... H01R 13/436 439/79
6,203,373 B1 * 3/2001 Lin ..... H01R 13/6582 439/607.27
6,210,224 B1 * 4/2001 Wu ..... H01R 13/658 439/607.4
6,991,494 B1 * 1/2006 Spink, Jr. ..... H01R 13/745 439/607.27

(Continued)

OTHER PUBLICATIONS

PCT International Search Report, International Application No. PCT/EP2018/065707, dated Sep. 26, 2018, 13 pages.

*Primary Examiner* — Harshad C Patel
(74) *Attorney, Agent, or Firm* — Barley Snyder

(57) ABSTRACT

A connector assembly includes a connector, a circuit board having a first soldering pin and a second soldering pin electrically connected with the first soldering pin, a cable having a wire with a conductor, and an outer shield housing mounted on the circuit board and covering the connector, the cable, and the circuit board. The connector includes a shield housing, an insulation body disposed in the shield housing, and a conductive terminal held in the insulation body. The conductive terminal is soldered to the first soldering pin. The conductor is soldered to the second soldering pin.

20 Claims, 2 Drawing Sheets

(56) References Cited

U.S. PATENT DOCUMENTS 7,081,017 B2 * 7/2006 Shuey ..... H01R 13/659 439/607.36
7,351,107 B1 * 4/2008 Burlock ..... H05K 3/308 439/607.37
7,462,071 B1 * 12/2008 Wu ..... H01R 9/032 439/497
7,625,236 B1 * 12/2009 Wu ..... H01R 24/62 439/607.58
7,651,379 B1 * 1/2010 Wu ..... H01R 13/6658 439/660
7,758,374 B2 * 7/2010 Yu ..... H01R 24/60 439/493
8,337,248 B1 * 12/2012 Lan ..... H01R 12/57 439/607.35
8,376,783 B2 * 2/2013 Kondo ..... H01R 12/712 439/660
8,608,520 B2 * 12/2013 Yuan ..... H01R 12/53 439/886
9,059,543 B2 * 6/2015 Wu ..... H01R 13/652
9,401,573 B1 * 7/2016 Fernandez ..... H01R 13/6593
9,437,982 B2 * 9/2016 Wu ..... H01R 13/665
9,472,910 B2 * 10/2016 Little ..... H01R 24/60
9,478,923 B2 * 10/2016 Kao ..... H01R 24/60
9,634,423 B2 * 4/2017 Chien ..... H01R 13/6658
9,680,260 B2 * 6/2017 Fan ..... H01R 13/6593
9,774,111 B2 * 9/2017 Liang ..... H01R 13/6469
9,793,657 B2 * 10/2017 Du ..... H01R 12/724
2006/0025014 A1 * 2/2006 Spink ..... H01R 13/745 439/607.27
2007/0117459 A1 * 5/2007 Chen ..... H01R 13/6594 439/607.01
2009/0042421 A1 * 2/2009 Zheng ..... H01R 12/712 439/83
2015/0288107 A1 10/2015 Wu et al.
2015/0380871 A1 * 12/2015 Kao ..... H01R 13/6595 439/607.27
2016/0141804 A1 * 5/2016 Kao ..... H01R 13/6582 439/607.01
2016/0254619 A1 * 9/2016 Toda ..... H01R 13/6467 439/607.01
2017/0018867 A1 * 1/2017 Kimura ..... H01R 13/6581

* cited by examiner

CONNECTOR ASSEMBLY

CROSS-REFERENCE TO RELATED APPLICATIONS

This application is a continuation of PCT International Application No. PCT/EP2018/065707, filed on Jun. 13, 2018, which claims priority under 35 U.S.C. § 119 to Chinese Patent Application No. 201710455276.2, filed on Jun. 16, 2017.

FIELD OF THE INVENTION

The present invention relates to a connector assembly and, more particularly, to a connector assembly with an outer shield housing.

BACKGROUND

In some existing applications, a connector cannot be electrically connected to a wire of a cable directly, so it is necessary to solder the connector on a circuit board and electrically connect the connector to the wire of the cable through the circuit board. However, in these applications, soldering pins and conductive traces on the circuit board electrically connected to the connector and the cable are directly exposed to an outside area, so that the entire product has poor electromagnetic shielding performance. In addition, when the cable is subjected to an external pulling force, the wire of the cable soldered to the circuit board is easily separated from the circuit board. Therefore, the entire product has poor tensile performance.

SUMMARY

A connector assembly includes a connector, a circuit board having a first soldering pin and a second soldering pin electrically connected with the first soldering pin, a cable having a wire with a conductor, and an outer shield housing mounted on the circuit board and covering the connector, the cable, and the circuit board. The connector includes a shield housing, an insulation body disposed in the shield housing, and a conductive terminal held in the insulation body. The conductive terminal is soldered to the first soldering pin. The conductor is soldered to the second soldering pin.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
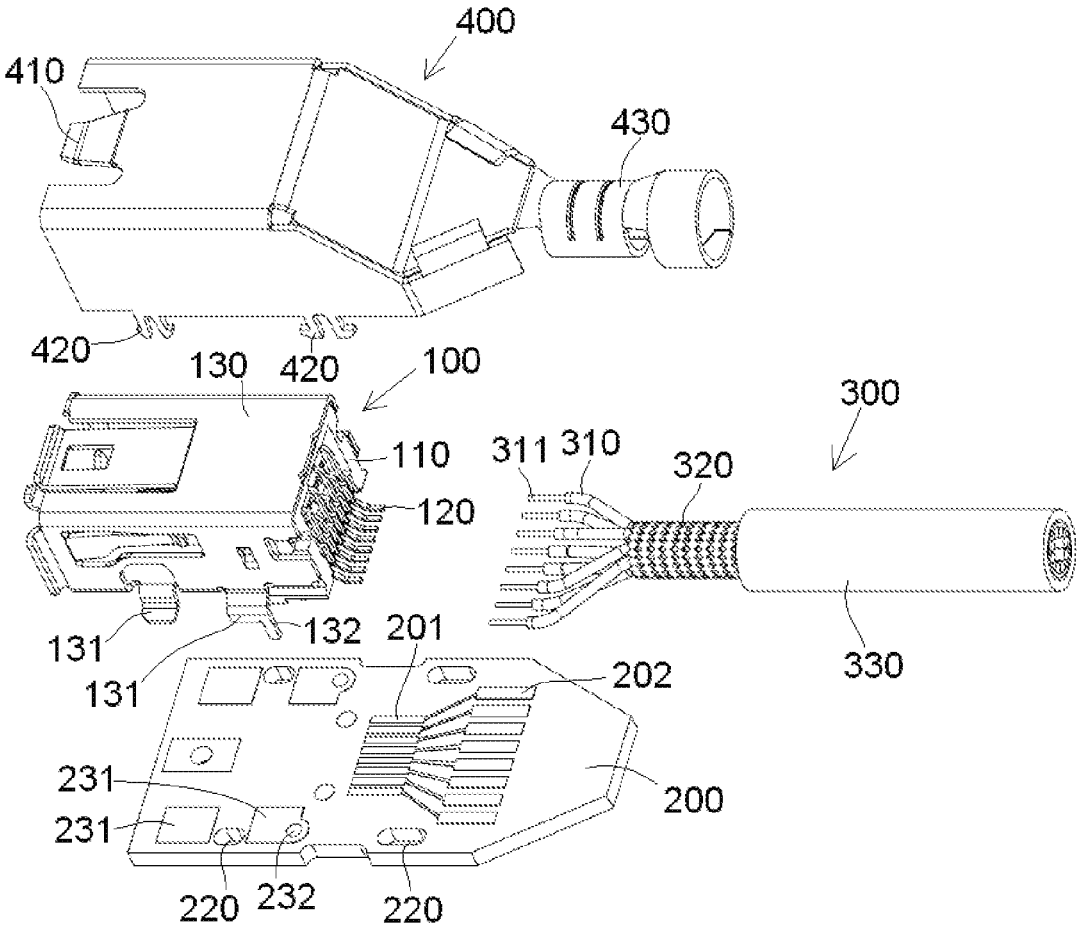
FIG. 1 is an exploded perspective view of a connector assembly according to an embodiment.

The technical solution of the disclosure will be described hereinafter in further detail with reference to the following embodiments, taken in conjunction with the accompanying drawings. In the specification, the same or similar reference numerals indicate the same or similar parts. The description of the embodiments of the disclosure hereinafter with reference to the accompanying drawings is intended to explain the general inventive concept of the disclosure and should not be construed as a limitation on the disclosure.

In addition, in the following detailed description, for the sake of explanation, numerous specific details are set forth in order to provide a thorough understanding of the disclosed embodiments. It will be apparent, however, that one or more embodiments may also be practiced without these specific details. In other instances, well-known structures and devices are illustrated schematically in order to simplify the drawing.

Figure 2:
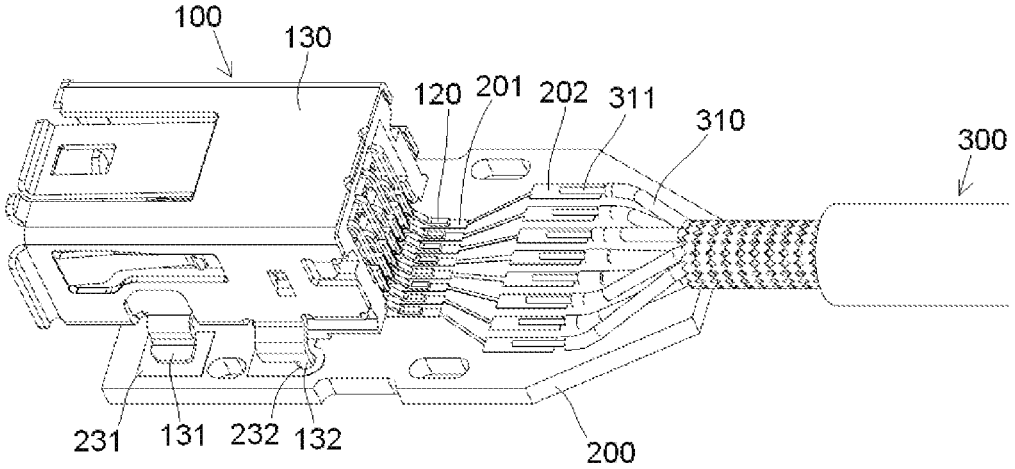
FIG. 2 is a perspective view of a connector, a circuit board, and a cable of the connector assembly assembled together.
Figure 3:
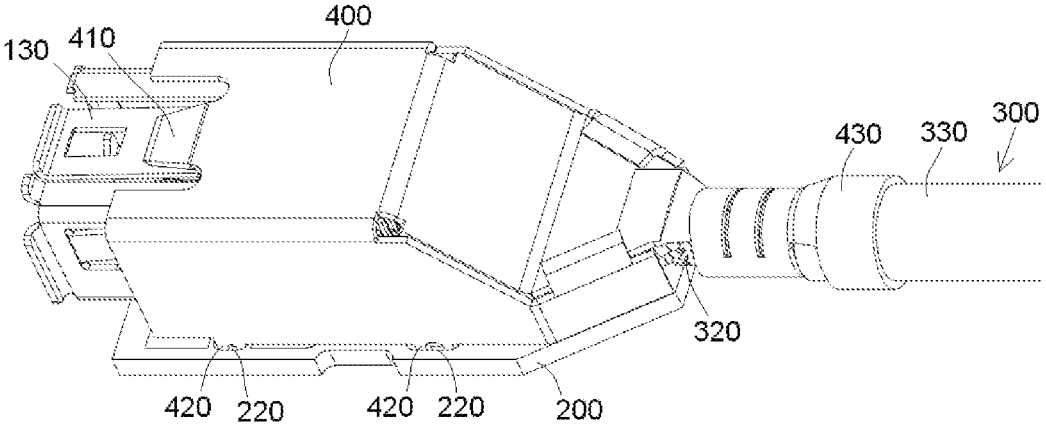
FIG. 3 is a perspective view of the connector assembly in an assembled state.

A connector assembly according to an embodiment, as shown in FIGS. 1-3, comprises a connector 100, a circuit board 200, a cable 300, and an outer shield housing 400.

The connector 100, as shown in FIG. 1, includes a shield housing 130, an insulation body 110 accommodated in the shield housing 130, and a conductive terminal 120 held in the insulation body 110.

The circuit board 200, as shown in FIG. 1, has a first soldering pin 201 and a second soldering pin 202 electrically connected to the first soldering pin 201 on a surface of the first soldering pin 201. In an embodiment, the circuit board 200 is a printed circuit board.

The cable 300, as shown in FIGS. 1 and 2, has a wire 310, an electrically conductive shield layer 320 wrapped around the wire 310, and an outer insulation layer 330 wrapped around the conductive shield layer 320.

The conductive terminal 120, as shown in FIG. 2, is soldered to the first soldering pin 201 on the circuit board 200. Each wire 310 has a conductor 311 soldered to the second soldering pin 202 on the circuit board 200. The conductive terminal 120 on the connector 100 is electrically connected to the wire 310 of the cable 300 through the circuit board 200.

As shown in FIG. 3, the connector 100, the cable 300, and the circuit board 200 are covered with the outer shield housing 400. In this way, the first and second soldering pins 201, 202 and electrically conductive traces on the circuit board 200 which are electrically connected to the connector 100 and the cable 300 are enclosed in the outer shield housing 400, improving the electromagnetic shielding effect of the entire connector assembly.

The outer shield housing 400, as shown in FIGS. 1 and 3, has a crimp ring 430 at a rear end of the outer shield housing 400. The crimp ring 430 is crimped over the conductive shield layer 320 and the outer insulation layer 330 of the cable 300. An external pulling force applied to the cable 300 will be directly transmitted to the outer shield housing 400, rather than being transmitted to the wire 310 of the cable 300. Thus, it is possible to prevent the wire 310 from being pulled away from the circuit board 200, thereby improving the tensile performance of the entire connector assembly.

The outer shield housing 400, as shown in FIGS. 1 and 3, has an elastic sheet 410 in elastically electrical contact with the shield housing 130 of the connector 100 so that the outer shield housing 400 is electrically connected with the shield housing 130 of the connector 100. In this way, it is possible to further improve the electromagnetic shielding effect of the entire connector assembly.

As shown in FIG. 3, the outer shield housing 400 is mounted on the circuit board 200 in a snap-fit manner. The outer shield housing 400 has at least one pair of elastic hooks 420 on opposite sides of the housing 400. The circuit board 200 has at least one slot 220. Each pair of elastic hooks 420 are adapted to be snapped into one corresponding slot 220 so as to secure the outer shield housing 400 onto the circuit board 200.

The shield housing 130 of the connector 100, as shown in FIGS. 1-3, has at least one soldering leg 131 on opposite sides of the shield housing 130. The circuit board 200 has a soldering pad 231 corresponding to the soldering leg 131. The soldering leg 131 is soldered onto the soldering pad 231. The soldering leg 131 has a leg portion 132, and the circuit board 200 has an insertion hole 232 corresponding to the leg portion 132. The leg portion 132 is inserted into the insertion hole 232.

The connector 100, as shown in FIGS. 1 and 2, has a plurality of conductive terminals 120. The cable 300 has a plurality of wires 310. The circuit board 200 has a plurality of the first soldering pins 201 and a plurality of second soldering pins 202. The plurality of electrically conductive terminals 120 on the connector 100 are respectively soldered to the plurality of first soldering pins 201 on the circuit board 200. The plurality of wires 310 of the cable 300 are respectively soldered to the plurality of second soldering pins 202 on the circuit board 200.

The plurality of first soldering pins 201 are arranged in a row, and the plurality of second soldering pins 202 are also arranged in a row, as shown in FIGS. 1 and 2. A row of first soldering pins 201 are located in front of a row of second soldering pins 202 with respect to the cable 300. The plurality of first soldering pins 201 are electrically connected to the plurality of second soldering pins 202 through a plurality of electrically conductive traces formed on the circuit board 200.

It should be appreciated by those skilled in this art that the above embodiments are intended to be illustrative, and many modifications may be made to the above embodiments by those skilled in this art, and various structures described in various embodiments may be freely combined with each other without conflicting in configuration or principle.

Although the disclosure have been described hereinbefore in detail with reference to the attached drawings, it should be appreciated that the disclosed embodiments in the attached drawings are intended to illustrate embodiments of the disclosure by way of example, and should not be construed as limitation to the disclosure.

Although several exemplary embodiments have been shown and described, it would be appreciated by those skilled in the art that various changes or modifications may be made to these embodiments without departing from the principles and spirit of the disclosure, the scope of which is defined by the claims and their equivalents.

What is claimed is:

1. A connector assembly, comprising:

a connector including a shield housing, an insulation body disposed in the shield housing, and a conductive terminal held in the insulation body, the shield housing has a first soldering leg on a side of the shield housing;

a circuit board having a first soldering pin and a second soldering pin electrically connected with the first soldering pin, the connector mounted on a first side of the circuit board with the conductive terminal having a portion extending parallel to the first side and soldered to the first soldering pin, the circuit board has a first soldering pad extending over the first side of the circuit board, the first soldering leg has a leg portion and the circuit board has an insertion hole, the leg portion inserted into the insertion hole and electrically connected with the circuit board at the insertion hole;

a cable having a wire with a conductor, the conductor soldered to the second soldering pin; and an outer shield housing mounted on the first side of the circuit board and covering the connector including the shield housing, the cable, and the circuit board, the outer shield housing has a pair of elastic hooks on a side and extending from a bottom surface of the outer shield housing, the circuit board has a slot, the pair of elastic hooks are elastically snap-fit into the slot to secure the outer shield housing on the first side of the circuit board.

2. The connector assembly of claim 1, wherein the outer shield housing has a crimp ring at a rear end of the outer shield housing.

3. The connector assembly of claim 2, wherein the crimp ring is crimped over a conductive shield layer and an outer insulation layer of the cable.

4. The connector assembly of claim 1, wherein the outer shield housing has an elastic sheet in elastically electrical contact with the shield housing of the connector, the outer shield housing is electrically connected with the shield housing of the connector.

5. The connector assembly of claim 1, wherein the connector has a plurality of conductive terminals and the cable has a plurality of wires.

6. The connector assembly of claim 5, wherein the circuit board has a plurality of first soldering pins and a plurality of second soldering pins, the plurality of conductive terminals soldered to the plurality of first soldering pins and the plurality of wires soldered to the plurality of second soldering pins.

7. The connector assembly of claim 6, wherein the plurality of first soldering pins are arranged in a row and the plurality of second soldering pins are arranged in a row.

8. The connector assembly of claim 7, wherein the row of first soldering pins are located in front of the row of second soldering pins.

9. The connector assembly of claim 8, wherein the plurality of first soldering pins are electrically connected to the plurality of second soldering pins through a plurality of conductive traces on the circuit board.

10. The connector assembly of claim 1, wherein the outer shield housing is formed in a single piece.

11. The connector assembly of claim 1, wherein the circuit board has a second soldering pad and the shield housing has a second soldering leg on the side of the shield housing, the second soldering leg soldered to the second soldering pad.

12. The connector assembly of claim 11, wherein the outer shield housing covers the first soldering pad and the second soldering pad.

13. The connector assembly of claim 1, wherein the insulation body and the shield housing are disposed only on the first side of the circuit board.

14. The connector assembly of claim 1, wherein the outer housing covers the conductive terminal, the first soldering pin, and the second soldering pin on the first side of the circuit board.

15. The connector assembly of claim 14, wherein the conductive terminal extends from the insulation body and through an opening in the shield housing in a direction toward the cable.

16. A connector assembly, comprising:

a connector including a shield housing, an insulation body disposed in the shield housing, and a conductive terminal held in the insulation body, the shield housing has a first soldering leg on a side of the shield housing;

a circuit board having a first soldering pin and a second soldering pin electrically connected with the first soldering pin formed on a first side of the circuit board, the shield housing and the insulation body mounted to the first side of the circuit board, the conductive terminal having a portion extending parallel to the first side and soldered to the first soldering pin, the circuit board has a first soldering pad extending over the first side of the circuit board, the first soldering leg has a leg portion and the circuit board has an insertion hole, the leg portion inserted into the insertion hole and electrically connected with the circuit board at the insertion hole;

a cable having a wire with a conductor, the conductor soldered to the second soldering pin; and an outer shield housing mounted to the first side of the circuit board and covering the connector including the shield housing, the cable, and the circuit board.

17. The connector assembly of claim 16, wherein the circuit board has a second soldering pad and the shield housing has a second soldering leg on the side of the shield housing, the second soldering leg soldered to the second soldering pad.

18. The connector assembly of claim 17, wherein the outer shield housing covers the conductive terminal, the first soldering pin, the second soldering pin, the first soldering pad and the second soldering pad.

19. The connector assembly of claim 18, wherein the insulation body and the shield housing are disposed only on the first side of the circuit board.

20. The connector assembly of claim 19, wherein the conductive terminal extends from the insulation body and through an opening in the shield housing in a direction toward the cable.

* * * * *